United States Patent [19]

Tenconi

[11] 4,077,238

[45] Mar. 7, 1978

[54] NEEDLE SELECTING DEVICE IN A CIRCULAR KNITTING MACHINE

[76] Inventor: Riccardo Tenconi, Via Tallera, 20, Varese, Italy

[21] Appl. No.: 782,479

[22] Filed: Mar. 29, 1977

[30] Foreign Application Priority Data

Apr. 9, 1976 Italy ..... 22137A/76

[51] Int. Cl.[2] ..... D04B 15/74

[52] U.S. Cl. ..... 66/50 B

[58] Field of Search ..... 66/50 B, 50 A, 25, 75.2

[56] References Cited

U.S. PATENT DOCUMENTS

| | | | |
|---|---|---|---|
| 3,066,508 | 12/1962 | Mazzi | 66/50 B |
| 3,077,756 | 2/1963 | Widdowson et al. | 66/50 A |
| 3,422,639 | 1/1969 | Saunders | 66/25 |
| 3,911,697 | 10/1975 | Cotte et al. | 66/50 B |

FOREIGN PATENT DOCUMENTS

| | | | |
|---|---|---|---|
| 615,617 | 1/1961 | Italy | 66/75.2 |

*Primary Examiner*—Wm. Carter Reynolds
*Attorney, Agent, or Firm*—Guido Modiano; Albert Josif

[57] ABSTRACT

Needle selecting device in a circular knitting machine of the type having oscillating needle pusher jacks. The selection is effected by engaging teeth of a toothed selection disk with corresponding pattern butts of respective needle pusher jacks. The jacks are moved into an inoperative position where the jacks are not raised and do not lift the overlying needles to a thread pick up position at a given feed. The toothed disk is rotated by a coaxial entraining disk at a rotational speed such as to achieve substantially a rolling action between the needle cylinder and toothed disk. The disk is angularly displaceable with respect to the entraining disk between an angular position corresponding to engagement and an angular position of no engagement. The angular displacement is ensured by a lever having a hooked end which can be controllably inserted between the teeth of the toothed disk for temporarily stopping the rotation of the toothed disk with respect to the entraining disk against the bias of an elastic member placed between the toothed disk and the entraining disk. The entraining disk has a plurality of peripheral bosses equal in number to the number of the teeth of the toothed disk and shaped to guide the hooked end to a position releasing the toothed disk. The hooked end is provided with discrete engagement surfaces for engagement respectively with the bosses and with the teeth of the toothed disk.

4 Claims, 11 Drawing Figures

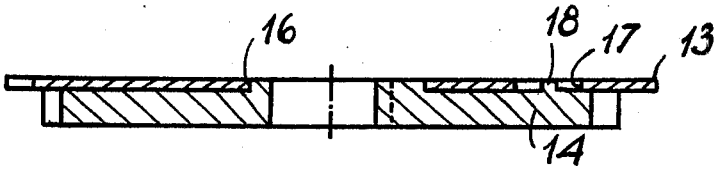
Fig. 3
Fig. 2
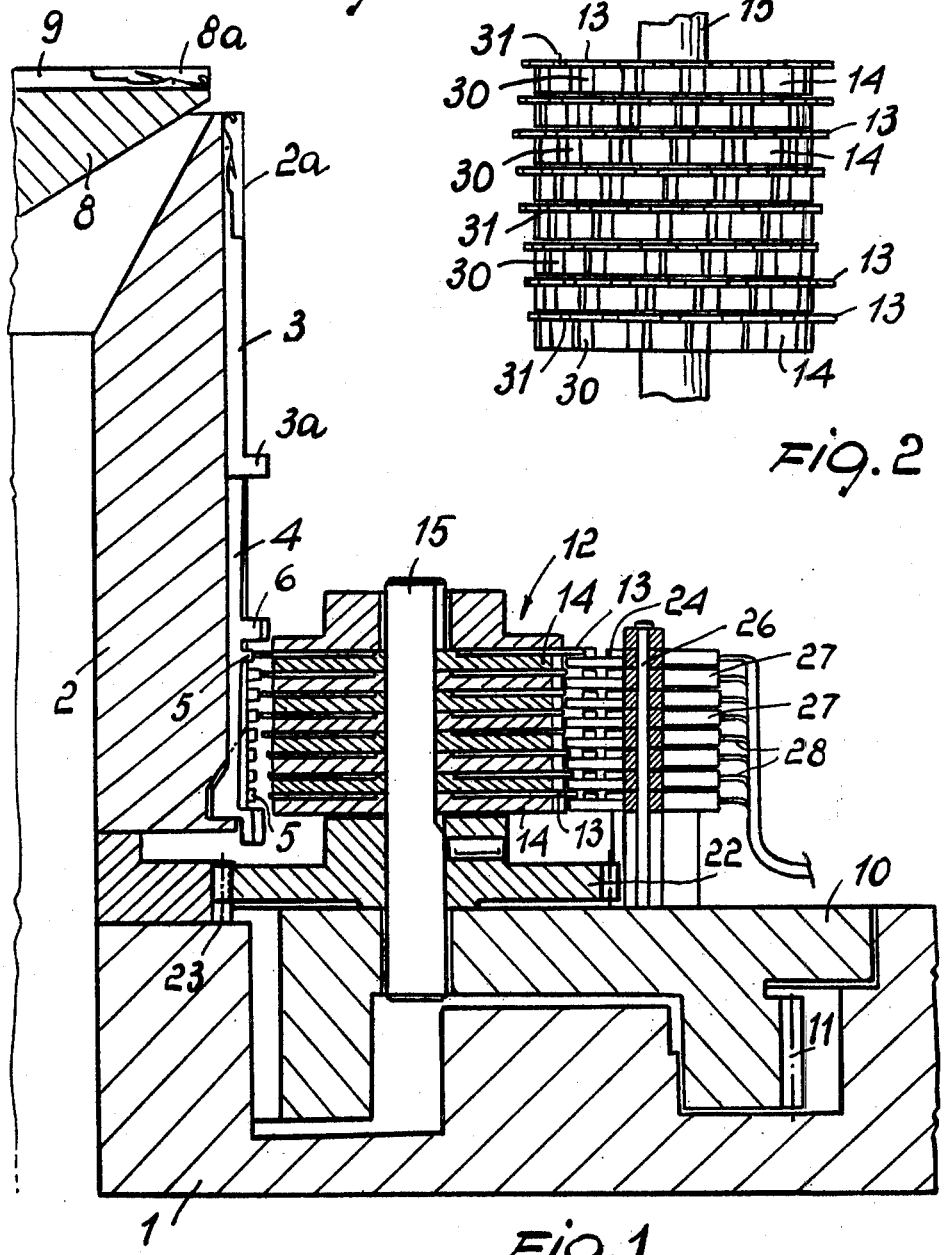
Fig. 1

NEEDLE SELECTING DEVICE IN A CIRCULAR KNITTING MACHINE

BACKGROUND OF THE INVENTION

This invention relates to a needle selecting device in a circular knitting machine. More particularly, the invention relates to those machines which are equipped with oscillating needle pusher jacks, wherein the selection is effected through the engagement of a tooth of a toothed selection disk with a pattern butt of a needle pusher jack, thus causing the jack to move into an inoperative position wherein it is not raised and does not lift the overlying needle into its thread pick up position at a given feed, the toothed disk being rotated by a coaxial entraining disk at a rotational speed such as to produce a substantially rolling action between the needle cylinder and toothed disk, and being angularly displaceable with respect to the entraining disk between an angular position corresponding to said engagement and an angular position of no engagement, a lever being provided for the angular displacement action having a hooked end which can be controllably inserted between the teeth of the toothed disk to temporarily stop the toothed disk rotational movement with respect to the entraining disk against the bias of a resilient means placed between the toothed disk and entraining disk.

A device of this type is disclosed in Italian Patent No. 811,297. Two embodiments are described in that patent, being applied to a hose knitting machine with rotating needle cylinder. In a first embodiment, the arrangement is such that during the normal rotation of the two disks, without the hooked lever coming into operation, each tooth of the toothed disk is pressing against a corresponding butt, of a jack, thereby the jack is commonly shifted to an inoperative position, while the braking action of the hooked lever leads each time to a temporary phase displacement with respect to the position of normal rotation for a time length as required to prevent an interaction between one tooth of the toothed disk and the butt of the corresponding jack from occurring, thus holding the jack in an operative position, wherefrom it is then lifted to cause the overlying needle to pick up the thread of the successive feed. The contrary happens instead in the second of such embodiments, i.e. in the normal entrainment condition there exists a phase displacement of the tooth and corresponding jack butt, which prevents their mutual engagement, thereby the jacks are commonly held in an operative position, while the temporary braking action of the hooked lever each time brings about an angular displacement such as to cause one tooth to interact with a butt for a sufficient time to effect the displacement to an inoperative position of the corresponding jack during the rotation of the entraining disk.

Thus, the programmed control of the hooked lever, bringing about an angular phase displacement of the toothed disk with respect to the rotatable entraining disk, permits in both embodiments alternation of the conditions of interaction between teeth and butts, thereby obtaining a determined selection.

The entrainment of the toothed disk is effected by means of a pin, rigid with the entraining disk and inserted through a circular opening in the toothed disk having a diameter appreciably larger than the pin diameter, thereby the two angular positions described above are defined by the pin engaging with a point on the circumference of the opening which is advanced or leading, and respectively retarded or following, relative to the pin direction of motion.

According to a particular feature, the hooked lever is subjected to the action of a spring, which tends to hold the lever with its hook in contact with the toothed disk, and is controlled by a solenoid which, when activated, pulls the lever against the spring bias to a position such as to hold the hook disengaged from the teeth of the toothed disk, thus maintaining the normal conditions of rotation of the two disks, and when de-activated releases the lever under the spring bias to the position of engagement with the toothed disk to create the stop condition of that disk. The activation and de-activation of the solenoid may be suitably controlled through a punched card system, implemented in conformity with the selection to be carried out, i.e. the pattern that is desired in the resulting knitwork.

The basic advantage of this device is that it allows the selection to be varied at will, since the selection is effected electrically and accordingly easily adjusted as desired, for instance by simply replacing the punched cards of the selection program. To this effect, the selection system is, at least in theory, far more advantageous than the systems providing pattern disks or drums having teeth arranged to suit the selection program, and wherein it is necessary to replace physically a whole set of disks or the entire drums each time the knitwork pattern is to be changed.

The selection by angular phase displacement according to the cited patent, however, is not entirely devoid of shortcomings, which have limited the application of that selection device, and in particular have prevented its application to circular knitting machines operating at a high speed, as is the case with modern machines.

It should be pointed out, in fact, that whenever two or more consecutive operations of the hooked lever are required to restrain in succession two or more consecutive teeth of the toothed disk, the hook, after releasing one tooth, must be quickly inserted in the space between the released tooth and following one in order to restrain the latter, which, however, has moved in the meantime forward to the normal entrainment position consequently to the releasing of the toothed disk, thereby the insertion space for the hook with respect to the actual space between the two teeth is considerably reduced. It will be apparent, therefore, how at high speeds it becomes impossible, owing to the forces of inertia involved, to effect in a reliable manner this insertion in a space that is growing gradually smaller.

On the other hand, to increase the responsiveness of the hook for returning into the position restraining the successive or following tooth, the spring holding it in that position would have to be made stronger, which would render the releasing action of the disk yet more difficult, as this action is required to occur against the bias of this spring by means of the same toothed disk driven in the phase displaced angular position by engagement of the pin of the entrainment disk with the opening in the toothed disk. In order to facilitate this releasing, the flanks of the toothed disk teeth would have to be configurated with a greater inclination in the release direction, which would affect the restraining action reliability, this action, moreover, occurring against the bias of the spring placed between the two disks. However, since the releasing of the lever from one tooth and the re-insertion thereof to stop another tooth require accurate timing, such as to prevent for sure the premature releasing of the toothed disk, and succeed in stopping it at an equally precise time, it will be apparent how only a highly accurate dimensioning of the various components, particularly of the two springs acting in opposition to each other, can afford a consistently correct operation, and how as the operating speed is increased the problems encountered further aggravate.

Furthermore, it does not seem proper to rely on the solenoid for the task of returning the hooked lever to its inoperative position, also for those cases when the lever is required to move immediately back to its operative position in order to engage the successive tooth, since this would require an even longer time owing to the longer angular travel distance the lever would have to cover, and besides more power would be wasted in the solenoid, which in turn would require the provision of larger size solenoids, possibly too large to fit into a limited space near the selection device.

The cited Italian Patent No. 811,297 also provides for a pad or shoe type of brake rather than a hooked lever, which shoe acts on the outer periphery of the teeth, and is not required to trip each time into the space between the teeth and then move out of said space. However, it has been found that such a shoe brake device is less reliable in operation, as it does not ensure the same positive holding capacity that a hook does, and this is further enhanced by the likelihood of oil getting between the shoe friction surface and the tooth, in which event the braking action would be entirely lost, resulting in a completely erroneous selection.

SUMMARY OF THE INVENTION

It is a primary object of this invention to overcome the drawbacks mentioned above, by improving the cited selection device such that it is enabled to operate in a more reliable manner, at higher speeds, without posing so critical size problems as the known device did.

This object is achieved by a needle selecting device, in a circular knitting machine of the type having oscillating needle pusher jacks, wherein the selection is effected by engaging teeth of a toothed selection disk with corresponding pattern butts of respective needle pusher jacks, thus causing the jacks to move into an inoperative position wherein the jacks are not raised and do not lift the overlying needles to a thread pick up position at a given feed, the toothed disk being rotated by a coaxial entraining disk at a rotational speed such as to achieve substantially a rolling action between the needle cylinder and toothed disk, and being angularly displaceable with respect to said entraining disk between an angular position corresponding to said engagement and an angular position of no engagement, said angular displacement being ensured by a lever having a hooked end which can be controllably inserted between the teeth of said toothed disk for temporarily stopping the rotation of said toothed disk with respect to said entraining disk against the bias of an elastic means placed between said toothed disk and said entraining disk, wherein said entraining disk has a plurality of peripheral bosses equal in number to the number of the teeth of said toothed disk and shaped to guide said hooked end to a position releasing said toothed disk, and that said hooked end is provided with discrete engagement surfaces for engagement respectively with said bosses and with the teeth of said toothed disk, said engagement surfaces being positioned and configurated to release said toothed disk on completion of the travel of said hooked end as determinated by said bosses.

Advantageously, said bosses are peripheral teeth in the entraining disk, having inclined flanks for guiding said hooked end.

With the arrangement provided by this invention, the displacement of the hooked lever to the release position is no longer operated by the entrained toothed disk, nor delegated to the actions of springs, but is instead effected by the entraining disk itself, directly through the bosses or teeth thereof, which permits said displacement to be carried out with the toothed disk held stationary, that is without stresses in a circumferential direction occurring between the toothed disk and hook, which would make the shifting to a release position more difficult. This not only affords higher operational speeds, but also the engaging surfaces between the toothed disk teeth and the hook to be maintained perfectly radial or possibly narrowing towards the disk body, providing an absolutely restraint or holding action. Furthermore, it becomes possible to operate at higher speeds also by virtue of the direct actuation of the hook by the entraining disk bosses permitting the use of a stronger biassing spring for the hook, favoring accordingly a quicker return thereof to the holding position.

BRIEF DESCRIPTION OF THE DRAWINGS

Further features and advantages of the invention will become more apparent from the following detailed description of a preferred, though not restrictive, embodiment thereof, intended to be merely exemplary and illustrated in the accompanying drawings, where:

FIG. 1 shows the inventive device as being applied to a circular knitting machine of the large diameter type having a fixed needle cylinder and rotating cams, in an axial vertical plane sectional view;

FIG. 2 is a side view of a set of toothed disks and related entraining disks underlying them, constituting one selection device;

FIG. 3 is an axial sectional view through a toothed disk and respective entraining disk;

DESCRIPTION OF THE PREFERRED EMBODIMENTS

A selection device according to the invention will be discussed hereinafter as applied to a circular knitting machine of the large diameter type having a fixed needle cylinder and rotating cams, more specifically of the type suitable for producing an open knitwork, such as disclosed in U.S. Pat. No. 3,521,466. However, it is intended that the invention also applies to large diameter circular knitting machines having a rotating needle cylinder and stationary cams, as well as to standard hose knitting machines.

Figure 4:
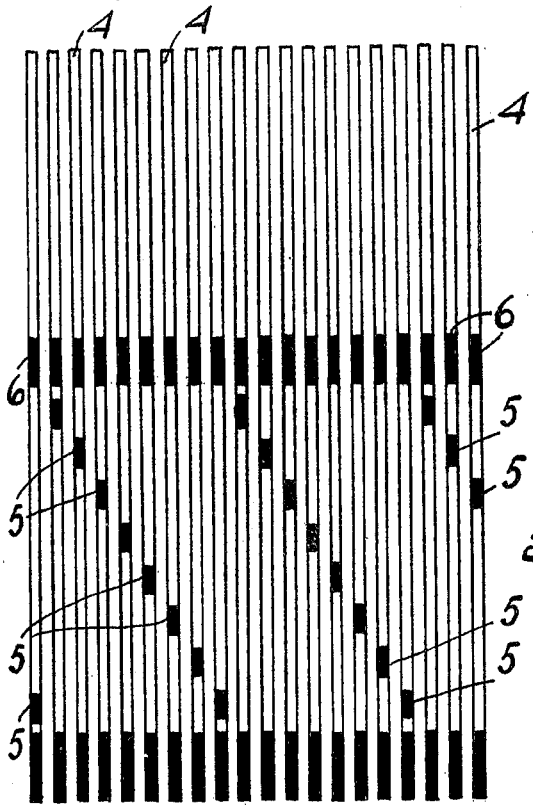
FIG. 4 is a schematic developed view of a set of needle pusher jacks with their pattern butts arranged diagonally.
Figure 5:
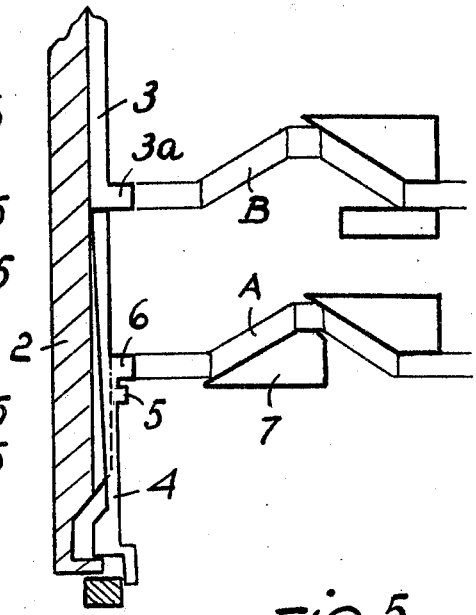
FIG. 5 is a partly sectional view of the needle cylinder, with part of the cam ring being depicted schematically on one side together with the path followed by the jacks and needles put into operation.

The machine under consideration comprises a fixed base or bed 1 and a stationary or fixed needle cylinder 2, along the vertical grooves 2*a* whereof are slidable the needles 3 and oscillating needle pusher jacks 4, which latter are provided, each in a known manner, with a pattern butt 5 and control butt 6. The pattern butts 5 of adjacent jacks are preferably arranged diagonally, as shown in FIG. 4. The jacks may take, in a known manner, a position further inside the groove 2*a*, as indicated for the front jack visible in FIG. 1, or a further out position, as indicated for the jacks which in FIG. 1 are located to the rear of the first jack, depending on whether their butts 5 are engaged by a pattern tooth of the selecting device. In the former instance, the jacks are left inoperative together with their correspondingly overlying needles, which accordingly pick up no thread at the subsequent feed, whereas in the latter instance they engage at their butt 6 with the cam 7 (FIG. 5) and are controlled or driven to follow the operative path A, while bringing into operation at the same time the overlying needle 3, which follows with its butt 3*a* the path B and picks up thread at the corresponding feed.

The machine further comprises a fixed disk 8 whereon horizontal needles 9 are arranged to slide along radial grooves 8*a* and driven or controlled by specially provided rotating cams above the disk 8.

The cams which control the needles 3 and jacks 4 are carried by a rotating structure 10, pivotally supported on the fixed base 1 and driven to rotate through a gear ring 11. On this rotating structure 10, there are arranged as many selection devices 12 as are the thread feeds of the machine, each device comprising a plurality of toothed selection disk pairs 13 and entraining disk pairs 14, coaxial to each other and substantially tangent the needle cylinder 2, the disks 14 being rigidly mounted on a vertical shaft 15 rotatably supported by the rotating structure 10. Each toothed disk 13 is held in position, on the respective entraining disk 14, by an annular ridge 16 and is associated with the entraining disk for angular displacement with respect thereto. To this aim, the disk 13 has a circular opening 17 wherethrough a pin 18 rigid with the disk 14 penetrates, the diameter of the pin 18 being appreciably less than the diameter of the opening 17, such as to allow for said relative angular displacement. A spring 19, accomodated in a slot 20 of the disk 14 and having its ends respectively secured to the disk 14 and a hook 21 of the toothed disk 13, commonly maintains the pin 18 in engagement with that point of the opening 17 which is retarded or following in the direction of rotation of the disks 13, 14.

In order to drive the shaft 15 rotatively, provision is made for a gear wheel 22 which meshes with a gear ring 23 rigidly secured to the needle cylinder 2; it follows from the above, that during the rotation of the structure 10 about the needle cylinder 2, the set of disks 13, 14, in addition to executing a revolution about the needle cylinder 2 together with the structure 10 also performs a rotation about its own axis. The drive ratio between the gear ring 23 and gear wheel 22 is such as to substantially achieve a rolling action of the disks 13 on the periphery of the needle cylinder 2.

Each pair of disks of the selection device 12 are phase displaced with respect to the adjacent pair by an angle substantially corresponding to the phase displacement between adjacent jacks 4, each pair being arranged to act selectively only on the butts 5 which are at the same level. In the example under examination, eight pairs of disks 13, 14 are provided, thereby the adjacent teeth of one toothed disk 13 are enabled to act on the butts of jacks spaced apart from one another by eight units (refer also to FIG. 4).

The selection device 12 further comprises a plurality of stop levers 24, one for each toothed disk 13, which are provided with a hooked end 25 and are journaled independently of one another to a vertical shaft 26 attached to the rotating structure 10, on one side of the disk stack. The hooked end 25 of each lever 24 is located in front of a respective solenoid 27, attached, as are all the other analogous solenoids, to the rotating structure 10, and being energizable through connections 28 according to the selection program, while the opposite end of the lever 24 is subjected to the action of a spring 29, which is attached to a pin rigid with the rotating structure 10 and tending to hold the hooked end 25 in a position of engagement with the respective toothed disk 13. When energized, the attractive force of the solenoid 27 overcomes the force of the spring 29, such as to pull the respective lever 24 to a position of disengagement from the toothed disk 13. In FIG. 1, the position of the levers 24, shaft 26 and solenoids 27 is indicated as moved rearwardly with respect to the position shown in FIGS. 7 to 10 for clarity reasons.

According to the invention, each entraining disk 14 has a plurality of bosses, preferably in the form of peripheral teeth 30, provided equal in number to the number of teeth 31 of the corresponding toothed disk 13 and so shaped as to cooperate with the hooked end 25 of the lever 24 in order to displace the lever in a position releasing the disk 13. The hooked end 25 of the lever 24 in turn, according to this invention, has two discrete engaging surfaces, 32 and 33, adapted to cooperate with the front (or leading in the direction of rotation) flanks of the teeth 30, 31, respectively. Most suitably, the leading flanks of the teeth 30 and the engaging surface 32 are inclined such as to favor the shifting of the lever to the position of release of the disk 13, while the leading flanks of the teeth 31, as well as the engaging surface 33, extend substantially radially to the disks 13, 14, so as to ensure a positive restraint of the disk 13. The engaging surface 33 is preferably defined by a boss 34 of the hooked end 25 and is positioned, with respect to the surface 32, by virtue of the relative positions of the teeth 30, 31, that is the pitch diameter of the disks 13 and 14, such as to permit the stop and release operations being described hereinafter.

In discussing the operation of the instant device, reference will be made in particular to FIGS. 7 to 10, wherein for simplicity reasons one pair of disks 13, 14 only is shown, and there are shown only those jack butts which are arranged at one and the same level, omitting those interposed therebetween and respective cylinder grooves. For clarity, the grooves 2*a* depicted have been drawn wider than they actually would be for the scale adopted. Moreover, the instance will be considered wherein, in normal conditions, i.e. with the hook 25 in its disengaged position, the relative positioning of the disks 13 and 14 with respect to the needle cylinder 2 is such as to cause the butts 5 to be pushed into an inoperative position, whereas to avoid pushing the butts 5 to such a position and leave the jacks 4 in their operative position, a relative phase displacement of the disk 13 with respect to the disk 14 is required.

Figure 7:
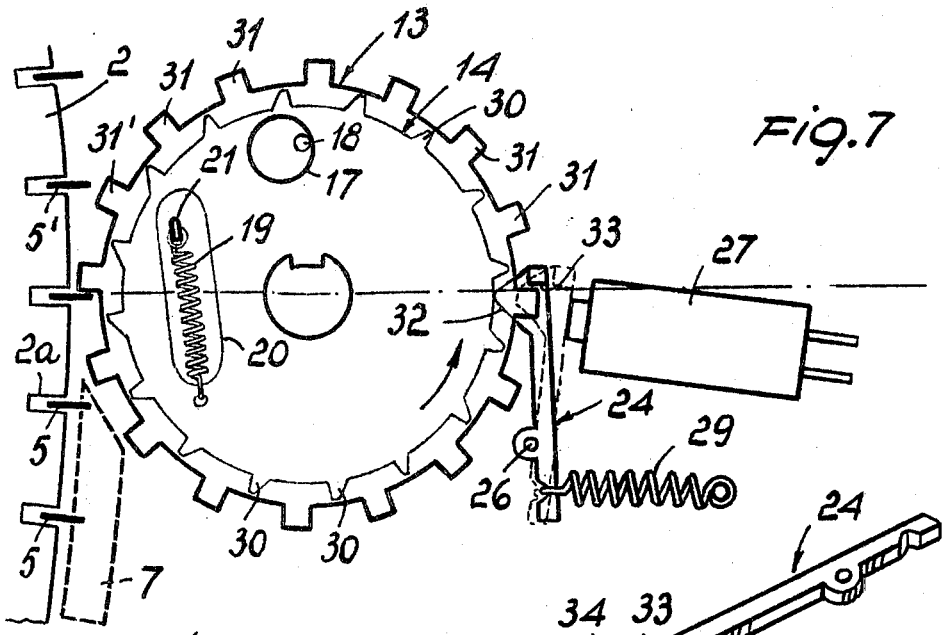
FIGS. 7, 8, 9 and 10 are top views of the inventive device in several operating positions, the device having been reduced for clarity to a single toothed disk and single entraining disk; again for clarity, the elements which are hidden from view have been represented with a lighter line rather than with dotted lines.
Figure 6:
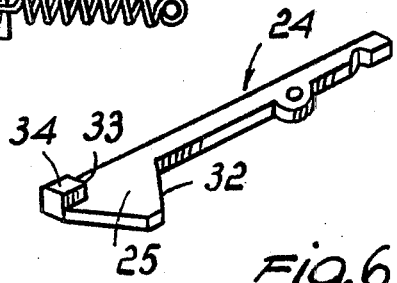
FIG. 6 is a perspective view of a hooked stop lever configurated according to this invention.
Figure 8:
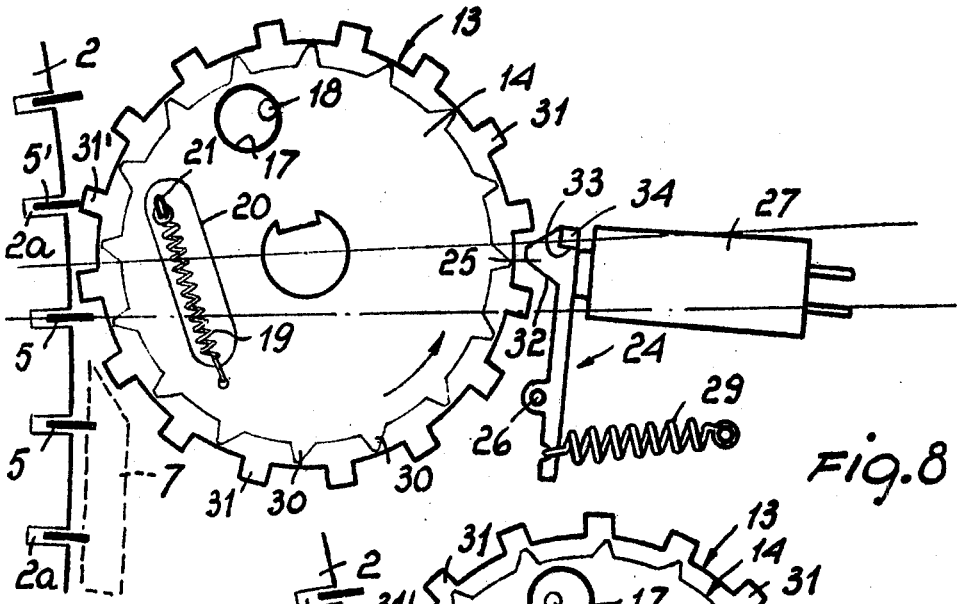

Let FIG. 7 be considered first, which shows the moment when, immediately after a selection is effected, a fresh selection is to be started, in the sense that the butt 5' may be pushed to an inoperative position by means of the tooth 31'. If that operation is to be carried out, the solenoid 27 is energized and the lever 24 attracted to the position shown in dotted lines in FIG. 7, where the hook 25 engages no tooth of the disk 13. In this condition, the two disks 13 and 14 rotate together about their own axis, as if they were rigid to each other, and move as a whole with the rotating structure 10. Therefore, a rolling movement of the disk 13 onto the needle cylinder 2 is obtained in practice, consequently whereto the tooth 31' is caused to engage with the butt 5', as shown in FIG. 8, to push it into its own groove *2a* to an inoperative position.

Figure 9:
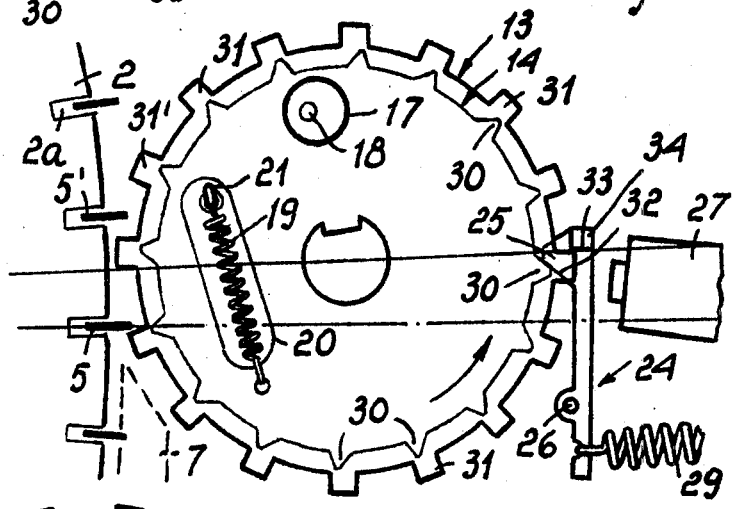

If on the contrary, the butt 5' is not to be pushed to an inoperative position, then the solenoid 27 is not energized, thereby the lever 24 is moved, under the action of the spring 29, with the tip of the hook 25 to contact the periphery of the disk 14 between two teeth 30, so that the boss 34 moves in front of the tooth 31 of the disk 13, as shown in full lines in FIG. 7. In this condition, the rotation of the disk 13 along with the disk 14 is prevented, the disk 13 continuing to rotate as normal, whereas the disk 14 is forced to simply shift to one side of the needle cylinder 2 as if it were rigid with the rotating structure 10. This avoids any engagement of the tooth 31' with the butt 5', as is apparent from a comparison of FIGS. 7 and 9. It should be noted here that the tip of the hook 25 is still engaging the periphery of the disk 14 between two consecutive teeth 30 during the rotation of the disk 14, but this has no influence on the lever 24 until the surface 32 meets the leading flank of the tooth 30, as shown in FIG. 9, where the disc 13 retaining step is on the point of being completed.

Figure 11:
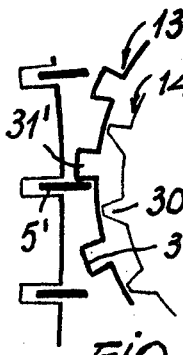
FIG. 11 shows an embodiment of the teeth of the toothed disk which is specially advantageous for use in this invention.
Figure 10:
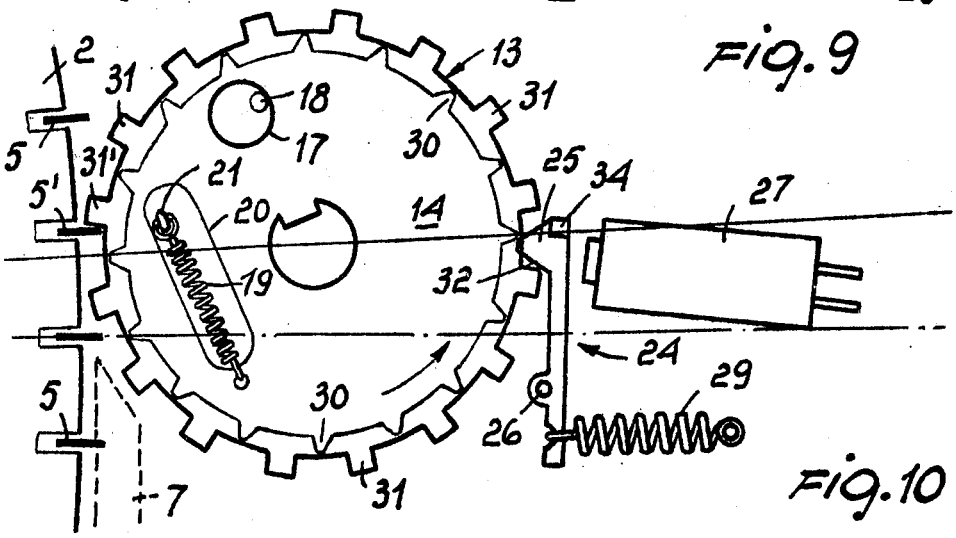

At this stage, in fact, the lever 24 is urged to gradually rotate clockwise, thus gradually reducing the contact area between the surface 33 and tooth 31 of the now stationary disk 13, until the tooth 31 and the entire disk 13 are fully released, as soon as the hook 25 reaches the topmost portion of the tooth 30, as shown in FIG. 10. The disk 13, tripped forward by the spring 19 action, is again brought to its normal entraining position, but without the tooth 31' interfering with the butt 5', since the tooth 31' locates itself behind the butt 5' because of the previous relative movement between the disk 13 and needle cylinder 2. In order to prevent the tooth 31' from striking the butt 5', it has been found suitable to arrange the teeth 31 with a pitch slightly shorter than the distance between the butts 5 at one and the same level, and to drive the disk 13 at a peripheral speed slightly below that corresponding to a mere rolling onto the needle cylinder 2. It would be also possible to narrow the tooth at its portion closest to the disk 13, as depicted in FIG. 11. It should be noted that the releasing of the disk 13 occurs shortly before the pin 18 reaches the forward or leading end (in the direction of rotation) of the opening 17, and accordingly with the toothed disk stationary; any engagement between pin and opening is but a safety measure in case the release of the disk is not correctly performed.

The position reached in FIG. 10 is that shortly preceding the position of FIG. 7, if the advance through one step effected by the disks 13, 14 is neglected. At this stage a fresh selection may take place as described. It will be obvious that if several consecutive butts at one and the same level are to be pushed to their inoperative position, then the solenoid 27 will be maintained energized for a corresponding time duration, and viceversa. In practice, the release position of the lever 24 in FIG. 10 and that of attraction shown in dotted lines in FIG. 7 will be made to differ only marginally, and this in order to hold at a minimum the distance of the lever from the solenoid, thus reducing the power required to pull or attract the lever, and accordingly the physical size of the solenoid. Furthermore, it will be apparent that during the carrying out of a selection operation by a pair of disks 13, 14, other phase displaced selections are being carried out for the jacks 4 intervening between those shown in FIGS. 7–10. All of these selections are controlled by pulses sent to the respective solenoids 27 and provided by an electronic selection programming device, made to operate according to the pattern to be obtained. It is perhaps obvious, moreover, how by varying the sequence of such pulses it becomes possible to vary the selection, i.e. to obtain another pattern in the knitwork without any need to perform mechanical adaptations of the selecting devices 12.

The invention just described is susceptible to many modifications and variations thereof, all of which fall within the scope of this inventive concept. Thus, for example, the bosses on the entraining disk 14 could, alternatively, be provided under the disk and be, for instance, cogs arranged to cooperate with the engagement surface 32 of the hooked end 25. Furthermore, it is also possible to reverse the operational conditions to the effect that the normal rolling of the disks 13, 14 is made to correspond to the butt condition of no engagement, and the butt engagement condition to the stopping of the disk 13. In this case, the release of the disk 13 could be advantageously utilized to complete the phase of butt pushing into their respective grooves. Understandably, the invention just described may also be applied to machines having a rotating needle cylinder: in the latter case, the disks 13, 14 would be arranged onto a stationary structure and would rotate about their own axes similarly to the needle cylinder. The shape of the hooked end 25 could be different from that illustrated, and so could be the shape of the teeth 30, without impairing the characteristic features of the respective cooperating surfaces. The disk 14 could have the same pitch diameter as the disk 13, in which case the surfaces 32 and 33 would be substantially equidistant from the centers of the disks 13, 14. For space reasons, the solenoids 27 and respective levers 24 could also be arranged in two or more stacked groups, spaced mutually apart along the periphery of the disks 13, 14.

I claim:

1. A needle selecting device in a circular knitting machine of the type having oscillating needle pusher jacks, wherein the selection is effected by engaging teeth of a toothed selection disk with corresponding pattern butts of respective needle pusher jacks, thus causing the jacks to move into an inoperative position wherein the jacks are not raised and do not lift the overlying needles to a thread pick up position at a given feed, the toothed disk being rotated by a coaxial entraining disk at a rotational speed such as to achieve substantially a rolling action between the needle cylinder and toothed disk, and being angularly displaceable with respect to said entraining disk between an angular position in which the teeth of said toothed disk are capable of engaging corresponding ones of said pattern butts and an angular position in which none of the teeth of said toothed disk engage a pattern butt, the angular displacement being ensured by a lever having a hooked end which can be controllably inserted between the teeth of said toothed disk for temporarily stopping the rotation of said toothed disk with respect to said entraining disk against the bias of an elastic means placed between said toothed disk and said entraining disk, wherein said entraining disk has a plurality of peripheral bosses equal in number to the number of the teeth of said toothed disk and shaped to guide said hooked end to a position releasing said toothed disk, and said hooked end is provided with discrete engagement surfaces for engagement respectively with said bosses and with the teeth of said toothed disk, said engagement surfaces being positioned and configurated to release said toothed disk on completion of the travel of said hooked end as determined by said bosses.

2. A device according to claim 1, wherein said bosses in said entraining disk comprise peripheral teeth having a front or leading flank inclined in the direction of release of said hooked end.

3. A device according to claim 1, wherein said hooked end has a boss or ridge defining that one of said engagement surfaces which is adapted to engage with the teeth of said toothed disk, said one of said engagement surfaces extending substantially radially to said toothed disk.

4. A device according to claim 1, wherein the teeth of said toothed disk have a shape narrowing slightly towards the portion closest to the body of said toothed disk, at least at the front or leading flank of each tooth.

* * * * *